United States Patent [19]

Brueckner et al.

[11] 4,177,418

[45] Dec. 4, 1979

[54] FLUX CONTROLLED SHUNT REGULATED TRANSFORMER

[75] Inventors: Karl H. Brueckner; Charles A. Farel, both of Boulder; Johnnie F. Irsik, Longmont, all of Colo.

[73] Assignee: International Business Machines Corporation, Armonk, N.Y.

[21] Appl. No.: 821,893

[22] Filed: Aug. 4, 1977

[51] Int. Cl.[2] ..... G05F 1/46; H01F 27/24; H01F 31/00

[52] U.S. Cl. ..... 323/56; 336/160; 336/215

[58] Field of Search ..... 323/6, 44 R, 56, 48, 323/89 C; 336/155, 160, 212, 214, 215

[56] References Cited

U.S. PATENT DOCUMENTS

| | | | |
|---|---|---|---|
| 1,376,978 | 5/1921 | Stoekle | 336/160 X |
| 2,235,330 | 3/1941 | Pugh | 323/56 X |
| 2,245,192 | 6/1941 | Gugel | 323/56 X |
| 2,976,478 | 3/1961 | Aske | 336/160 X |
| 3,087,108 | 4/1963 | Toffolo et al. | 336/215 X |
| 3,579,088 | 5/1971 | Fletcher et al. | 323/6 |
| 3,659,191 | 4/1972 | Spreadbury | 323/56 X |
| 3,965,408 | 6/1976 | Higuchi et al. | 323/56 X |
| 4,032,840 | 6/1977 | Lebedev et al. | 336/155 X |

*Primary Examiner*—A. D. Pellinen

*Attorney, Agent, or Firm*—James A. Pershon; Joscelyn C. Cockburn

[57] ABSTRACT

The output voltage of a transformer is regulated by controlling the flow of magnetic flux through a shunt core. The transformer includes a main core fabricated from U-I laminations and is arranged to form a substantially rectangular structure. A primary and a secondary coil are seated on the main core. A shunt core with shunt winding having lamination size and structure substantially analogous to that of the main core is positioned in spaced alignment to said main core. A flux interconnecting path, called the bottleneck, connects the main core and the shunt core to form a sturdy unified structure. The shunt winding is activated by control circuitry by which the flux flow through the shunt core is limited and hence the output voltage is regulated.

8 Claims, 8 Drawing Figures

FLUX CONTROLLED SHUNT REGULATED TRANSFORMER

CROSS-REFERENCE TO RELATED APPLICATION

The present application is related to application Ser. No. 821,892, filed concurrently herewith and assigned to the same assignee as the present application. The subject matter of the referenced application is considered to be an outgrowth from the present invention and hence is an improvement over the invention claimed in the present application.

BACKGROUND OF THE INVENTION

1. Field of the Invention

This invention relates to transformers and more particularly to voltage regulating transformers.

2. Description of the Prior Art

The principle of varying the voltage of a transformer by controlling its leakage flux is broadly old in the art. For example, in U.S. Pat. No. 2,245,192 the output voltage of a transformer is varied or controlled by varying the reluctance of both the main path flux and leakage flux path. To effectuate this control, parallel flux paths are fabricated in the main core of the transformer. Basically the transformer has a non-unified structure. Primary and secondary windings are seated on the main core, while saturating windings are seated on the parallel flux paths of the main core. An auxilliary core carrying saturating windings is positioned in shunt relationship and is encompassed by the main core. The patent does not disclose how the auxiliary core is supported relative to the main core. However, one would imagine that a support means of some kind is necessary to support the auxiliary core since this core is not in contact with the main core. Also, the setting of the gap and/or gaps between the main core and the auxillary core is not disclosed. However, due to the high reluctance characteristics of air to the flow of magnetic flux unless the air gap and/or gaps are within a certain specification, the effect of the auxiliary core on the main core may well be negligible. In fact, if the setting of the air gap and/or gaps is too wide, then the structure will no longer function as a voltage regulator since the leakage flux which is necessary to achieve voltage regulation will confine itself to flow in the main core rather than shunting to the auxiliary core.

In an attempt to ward off the non-regulating dilemma the main core is fabricated with parallel flux paths. However, the incorporation of parallel flux paths tends to increase the complexity of the transformer. Due to the complexity of the magnetic structure and the need for the critical setting of the air gap and/or gaps, the overall cost of the transformer tends to increase.

Another obvious limitation is that the transformer does not readily fit into a compact machine where space is limited.

Various attempts have been made in the prior art to design sturdy, rugged and compact voltage regulating transformers. In U.S. Pat. No. 1,614,254, a regulating transformer which regulates the voltage across a telephone receiver is disclosed. The transformer consists of a centrally located permalloy plate with two core sections arranged in space relationship but abutting said plate. Control windings are seated on each core section. The magnetic characteristic of the plate is such that, when the voltage across the receiver is within its predetermined range, the reluctance of the plate is minimal. By positioning the winding on the cores to be in series, the reluctance of the transformer is such that shunt loss is minimal. Whenever the voltage across the telephone lines rises, the flux through the transformer increases. This increases the permeability of the plate until a maximum value is reached. With the permeability of the core less than maximum the flux is forced to follow the individual cores. However since the coils are connected in series in opposing relationship, the flux produced by the current in one winding tends to neutralize the flux produced by the current in the other winding. The net result is that more current flows from the telephone line into the transformer. This in turn increases the reluctance of the permalloy plate. This process continues until a point is reached above which the voltage across the terminals of the telephone receiver cannot be increased.

The limitation on the above device is that the degree of voltage regulation is limited (i.e. narrow). This limitation stems from the fact that the voltage regulation is dependent on a fixed variable (i.e. the magnetic characteristics of the treated permalloy plate). The device is not suitable for use in an environment where the voltage regulating range is variable and/or dynamic.

SUMMARY OF THE INVENTION

In order to overcome the above noted shortcomings of the prior art, the present invention provides a shunt regulated transformer which is rugged, practical and simple in construction. The transformer is low cost, requires minimum installation space, and allows a wider range of regulation. The shunt regulated transformer of the present invention includes a rectangular shaped main core fabricated from U-I laminations. A primary coil and a secondary coil is seated on the main core. The lamination stack of the main core, among other things, is dependent on the power characteristic of the transformer. Two stacks of I-shaped laminations are connected to the main core. The stacks function as a "flux lens" to divert magnetic flux from the main core. Hence, the stacks are called bottlenecks. A shunt core with controlled windings and a construction similar to the main core is connected to the bottleneck to form a unified structure.

In one feature of the invention the coil on the shunt core is so arranged to have two windings on at least two legs of the shunt core. The number of turns in each winding are substantially equivalent.

In another feature of the invention the bottleneck is ferrite material. When ferrite is used to interconnect the main core and the shunt core the range over which the voltage is regulated is improved.

In still another feature of the invention, a feedback loop, which includes a switching control circuitry, interconnects the windings on the shunt core with the secondary windings on the main core. By sampling the output voltage and adjusting current flow to the shunt windings, the output voltage is maintained within tight tolerance.

In another feature of the invention a converting circuitry which converts AC to DC is connected to the output of the transformer.

In still another feature of the invention a filtering circuitry is connected to the converting circuitry of the transformer.

The foregoing and other features, and advantages of the invention will be apparent from the following more particular description of a preferred embodiment of the invention, as illustrated in the accompanying drawings.

DESCRIPTION OF THE PREFERRED EMBODIMENT

Since the theory of transformers and other magnetic circuits are well known to those skilled in the art; the following description relative to elementary magnetic theory is not an attempt to rehash well known principles. However, by highlighting the general magnetic theory which is relevant to the present invention it will be easier for one to recognize and appreciate the inventiveness of the present invention.

The induced secondary voltage of a transformer is governed by Faraday's Law which states:

$$e = d\lambda/dt \qquad \text{Eq. 1}$$

where $\lambda$ is the total flux linkage of a secondary coil, obtained by summing over all turns the flux ($\phi$) linking each turn. In view of equation 1:

$$\lambda = \sum_{n=1}^{n} \phi_n(t)$$

where $\phi_n$ is the flux linking the $n^{th}$ turn and n is a total number of turns. The secondary voltage can therefore be controlled by controlling the flux which links the secondary coil.

Figure 1:
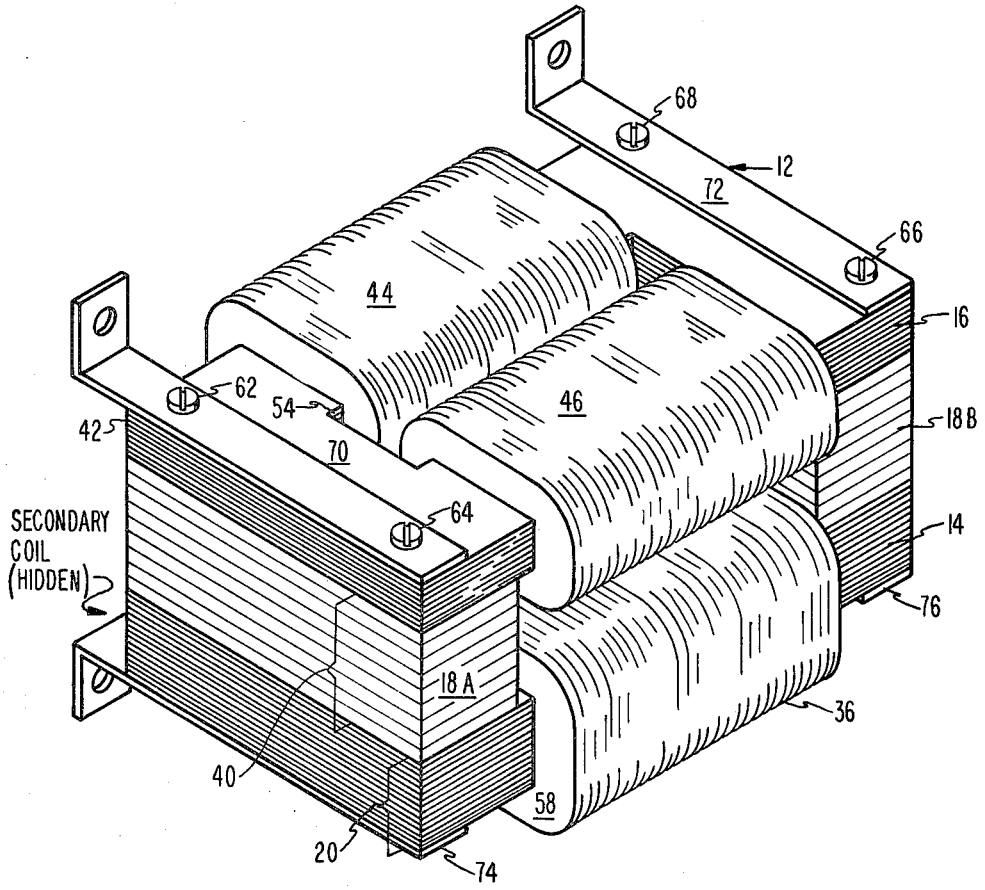
FIG. 1 is a pictorial illustration of the flux regulated transformer of the present invention.
Figure 3:
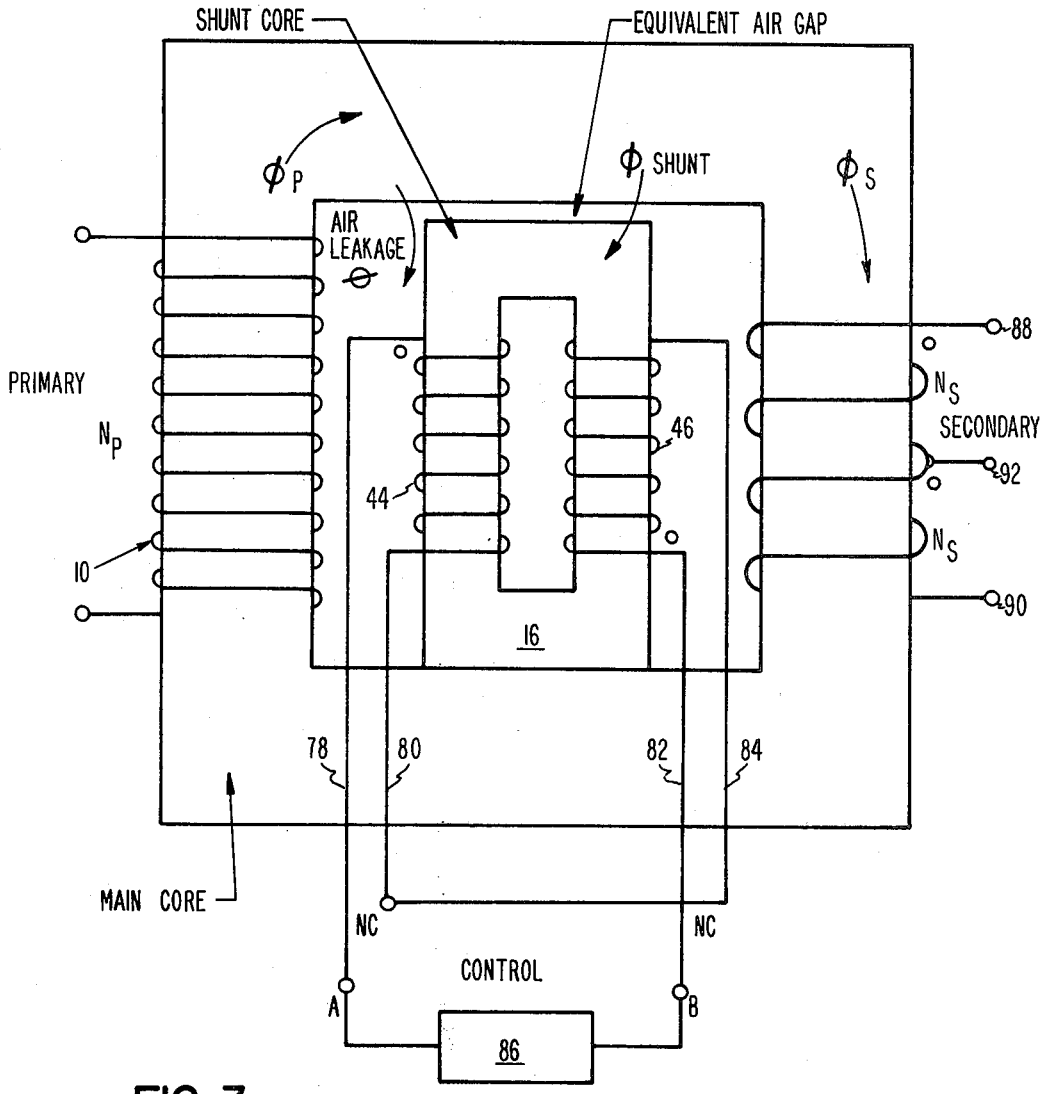
FIG. 3 depicts a magnetic equivalent circuit of the transformer shown in FIG. 1.

The present invention accomplishes this control (i.e. control of the secondary voltage) by providing a transformer having a structure as is shown in FIG. 1 with a shunt path of variable reluctance. Before describing the transformer shown in FIG. 1 let us turn to FIG. 3 for a moment. FIG. 3 is the magnetic equivalent circuit for the transformer of FIG. 1. Without describing at this point the details of FIG. 3 which will be covered subsequently suffice it to say that the total flux or primary flux ($\phi_p$) which is generated by the windings $N_p$ of primary coil 10 divides into three major paths. The first path is the air leakage path which is traversed by the air leakage flux ($\phi_{air\ leakage}$). The second path is the shunt path which is traversed by the shunt flux ($\phi_{shunt}$). The third path is the load path which is traversed by the secondary flux ($\phi_s$). As is evident from FIG. 3 only the flux which traverses the load path generates a secondary voltage. The amount of flux which traverses the load path is controlled by varying the amount of flux which traverses the shunt path. Assuming, of course, that the total flux is relatively constant. Expressing this mathematically:

$$\phi_{load} = \phi_{total} - \phi_{air\ leakage} - \phi_{shunt}$$

The quantity of flux which passes through the shunt path is controlled by varying the reluctance of the shunt path. The reluctance (R) of a magnetic material is:

$$R = l/\mu A$$

where l is the magnetic length and A the cross sectional area of the path, both of which are constant. The variable element is the permeability which may be expressed as $\mu = B/H$.

Figure 4:
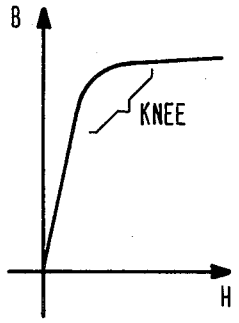
FIG. 4 shows a B-H curve and is helpful in understanding the operating characteristic of the transformer.

FIG. 4 shows a B/H curve and is helpful in understanding how the reluctance of the shunt path can be varied. The reluctance of the shunt path is variable and is dependent on the operating point selected along the B/H curve. For example, maximum variable shunt reluctance is achieved if the operating point is about the knee of the B/H curve. The operating point is selected and is controlled by the magnetomotive force (F=ni) of the shunt path.

Figure 6:
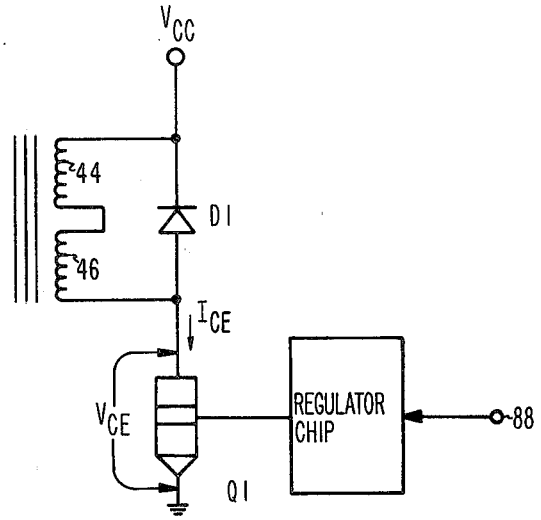
FIG. 6 shows the control circuitry which is positioned in the feed back loop of the transformer.
Figure 7:
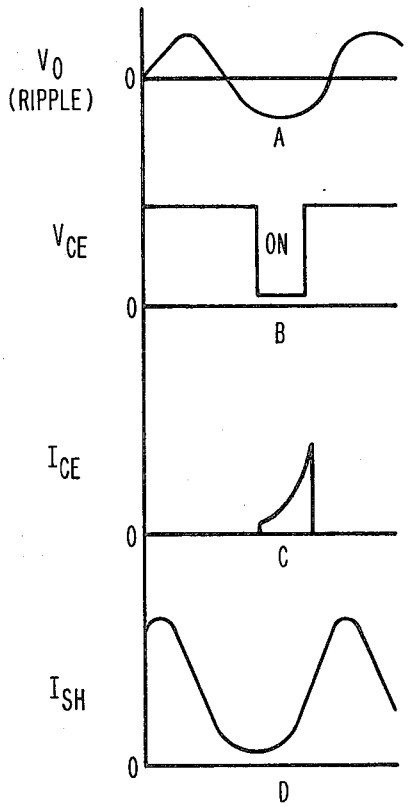
FIG. 7 shows graphs which are helpful in understanding the circuit of FIG. 6.
Figure 8:
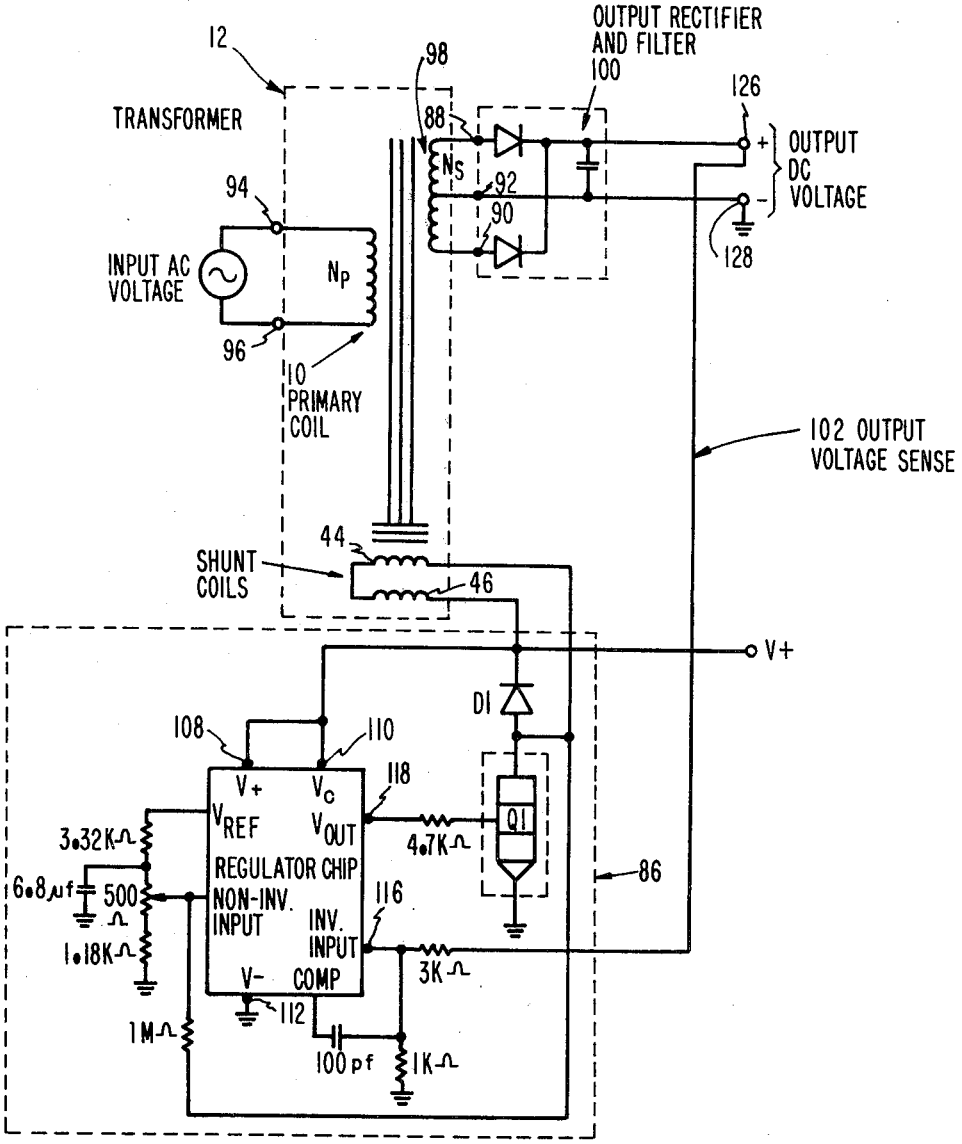
FIG. 8 is a schematic showing the transformer with control circuitry. In this schematic AC voltage is supplied to the transformer. The transformer regulates the voltage and distributes DC voltage.

Circuit means which varies the magnetomotive force and hence the reluctance of the shunt path is shown in FIGS. 6, 7 and 8. These control circuits will be discussed hereinafter. By introducing an air gap (FIG. 3) in the shunt path allows for coarse control of the shunt flux. While dynamic fine control is achieved by the magnetomotive force generated from the aforementioned control circuits.

Figure 2:
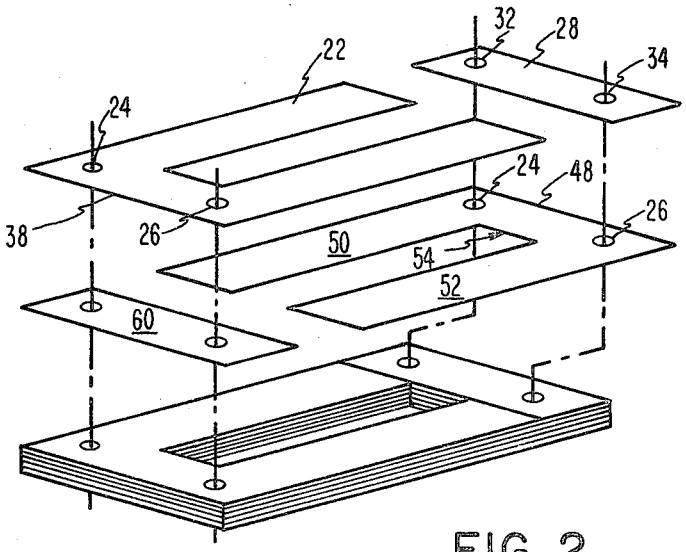
FIG. 2 shows the various parts of the transformer and is helpful in demonstrating and understanding the process used in fabricating the transformer.

Referring now to FIG. 1 a pictorial illustration of the flux control transformer 12 is shown. The components which are combined to form the transformer in FIG. 1 are shown in FIG. 1 and FIG. 2. By fabricating the transformer according to the teaching of the present invention a unique construction which is practical and economical to construct for both single and multilevel output is disclosed. The transformer includes a main core 14, shunt core 16 and interconnecting means 18A and 18B. The interconnecting means hereinafter called the bottleneck interconnects the main core with the shunt core. Its function is analogous to that of a lens, in an optical device, in that the bottleneck focuses or conducts magnetic flux away from the main core to the shunt core.

Still referring to FIGS. 1 and 2 the main core has a geometry which is substantially rectangular with a opening (void) or hole in the center. As will be explained subsequently, the void is necessary to accomodate the windings, only one of which is shown, which is positioned on the main core. The main core 14 is fabricated from a stack of U-I laminations. The height 20 of the lamination stack is dependent upon the power requirements of the transformer.

Referring to FIG. 2 for a moment the U-I lamaminations from which the transformer 12 is fabricated is shown. Each of the laminations 22 is fabricated from soft iron with a predetermined thickness. Holes 24 and 26 respectively, are fabricated in the bottom portion of the U. These holes are functional to receive the fastening means which unite the transformer into a rugged unified structure. The I-lamination 28 are fabricated from soft iron with a thickness equivalent to that of the U laminations. Holes 32 and 34 respectively, are fabricated at opposite ends of the I-laminations. The function which these holes serve is identical to the function which is served by the holes in the U-laminations.

Referring again to FIG. 1 primary coil 36 is seated on one leg of the main core. The primary coil is fabricated from conventional coil manufacturing techniques. However, the number of turns (N) and also the wire size which are used to fabricate the main core are dependent upon the power requirement of the transformer. A secondary coil (not shown) is seated on the opposite leg of the transformer core. A plurality of electrical conductors or electrical leads, not shown, are connected to the primary and secondary coil, respectively. As will be explained in the operational section of this application, input power or voltages are connected to the electrical leads which are interconnected to the primary coil. Similarly, the output regulated voltages are derived from the electrical conductors which are connected to the secondary winding.

Still referring to FIG. 1 the bottleneck portion of the transformer is attached to the main core. The function of the bottleneck portion is two-fold. Firstly, it supports and gives mechanical strength to the transformer. Secondly, it interconnects the main core with the shunt core and conducts magnetic flux away from the main core to the shunt core. As is shown in FIG. 1 the bottlenecks 18A and 18B are fabricated from a stack of I-shaped laminations. The characteristics of the I-shaped lamination which are used to fabricate the bottleneck are similar to the I-laminations previously described. The I-lamination in the bottleneck portion of the transformer are arranged so that they run parallel to edge 38 of the U-laminations which are used to fabricate the main and the shunt core. By arranging the laminations of the bottleneck in this manner flux, which is directed away from the main core, travels at right angles to the lamination stack. Although the lamination stack is held closely together for purposes of flux travel, an equivalent air gap (FIG. 3) is created by the lamination stack of the bottleneck and partially by the stacks of the main and the shunt cores. The height 40 of the bottleneck is designed so as to provide spacial clearance for the main core coils and shunt core coils. The material and dimensional properties of the bottleneck are chosen to allow coarse control over the maximum amount of flux flow to and from the shunt core.

As was mentioned previously, by using lamination stacks to fabricate the bottleneck, an equivalent air gap is created. With an air gap in the flux leakage path, the amount of flux which can be supplied to coils 44 and 46 is limited. Also power is dissipated due to eddy current loss in and near the bottleneck portion of the transformer. In an alternative embodiment of the present invention, this flux flow limitation is reduced and/or minimized when bottlenecks 18A and 18B, respectively, are fabricated from ferrite bars. Due to its high resistivity and lack of lamiminations, the ferrite bars reduce the air gap in the bottleneck and the eddy current loss.

In addition to ferrite, the bottleneck can be fabricated from a magnetic material having high resistivity.

The term bottleneck is derived from the limiting flow pattern of the flux from the main core to the shunt core. The maximum amount of flux traveling through the shunt core is limited by the high reluctance of the air gaps in the case of the I-lamination bottleneck, or by the reduced maximum flux density of the ferrite in the case of the ferrite bottleneck. In either case, the maximum amount of flux flow to and from the shunt core is determined primarily by the restrictive properties of the bottleneck. The effect is analogous to the restricted liquid flow from a bottle which has a relatively small neck and a relatively wide body portion. Hence, the term bottleneck.

Referring again to FIG. 1, the shunt core is fixedly mounted or connected to the bottlenecks. The shunt core is fabricated from a stack of U-I lamination similar to those used to fabricate the main core. However, the lamination stack height 42 may be different from the height 20 of the main core and is designed to accommodate the the maximum amount of flux passing through the bottlenecks. Control coils 44 and 46 respectively are seated on opposite legs of the shunt core. A plurality of electrical leads or conductors (not shown) as connected to the controlled windings. As will be explained subsequently, the control circuit means which generate the magnetomotive force which is necessary to control or regulate the output voltage is connected to the electrical conductors. The characteristics, such as turns ratio, wire size, etc. of the winding in coil 44 and 46 is dictated by the magnetomotive force which has to be generated to regulate the output voltage. Having described the various components of the flux regulated transformer a manufacturing procedure will now be described.

Fabricating the Transformer

Although the transformer of FIG. 1 may be fabricated using conventional means and methods some of which may be automatic and/or manual one method used to assemble the transformer is as follows: the primary coil 36 and secondary coil (not shown) are seated side by side on a work bench or support means. It is worthwhile noting that although the coils which are used in the subject transformer may have different shapes, in the preferred embodiment the coils are substantially cylindrical; with a coil opening or void running internally and parallel to the longest dimension of said coil. The coils are seated on the work bench so that the longest sides abut one another. One of the U-laminations, for example, lamination 48 (FIG. 2) is positioned within the coil openings of the primary and secondary coil. The lamination is so positioned that one of its legs for example, leg 50, is positioned within the opening of the secondary coil while the other leg for example, leg 52 is seated within the opening of the primary coil. The lamination 48 is forced into the opening until inner edge 54 abuts side 58, for example, of the coil (FIG. 1). I-shaped lamination 60 is then positioned relative and to abut the legs 50 and 52 of U-lamination 48. This combination (that is, I-shaped lamination 60 and U-shaped lamination 48) forms the basic rectangular component for either the main core or the shunt core. With the basic rectangular element in place a second rectangular element is formed in a manner similar to that used in forming the first rectangular element. The second rectangular element is formed by the U-lamination in a manner similar to that of the first. However, to form the second lamination the U-lamination, for example, lamination 22, is fitted into the openings of the primary and secondary coils from the opposite side of the coil. I-lamination 28 is then positioned relative to abut with the legs of U-lamination 22 thereby forming a second rectangular element of the main or shunt core. The process continues, that is alternative placing of U-I laminations from opposite ends of the coils until the desired height of the main core is achieved. The rectangular elements of the main core are so positioned that fastening holes 24, 26, 32 and 34, respectively, of each laminate are aligned with one another. This method of laminating referred to by the industry as interleaved, is preferred. Minimal performance degradation is expected through alternative methods, for example, butt joined laminations, where U-I laminations are not alternated from opposite ends of the coils.

Once the main core is formed the bottleneck portions 18A and 18B respectively, are next formed. As was stated previously, the bottleneck is fabricated from a stack of I-laminations positioned so that the holes 32 and 34 of each laminate are in alignment. Two bottleneck sections are formed and seated on the short dimension side of the rectangular main core. The bottlenecks are so positioned that the holes 32 and 34 are in alignment with holes 24 and 26 of the U-lamination. The shunt core is then formed in a manner substantially identical to that previously described in forming the main core with its associated coils. The shunt core and coil is then seated so as to be in contact with the bottleneck 18A and 18B, respectively (FIG. 1). The transformer is then bonded together by passing threaded screws or bolts 62, 64, 66 and 68 through the aligned holes. A plurality of nuts and washers (not shown) are threaded, in a conventional manner, onto the threaded portion of the screws. By torquing the screws or tightening the nut the transfomer is tightened to form a rugged device. Of course, it is within the skill of the art to use other tightening means for bonding the transformer together for structural strength.

Once the transformer is assembled a mounting means is then affixed onto the transformer. The mounting means allow the transformer to be mounted to a machine or support surface. In the preferred embodiment of this invention, the mounting means includes four L-shaped brackets, 70, 72, 74 and 76 respectively. Each of these mounting brackets are fabricated with three mounting holes, two of which are in alignment with the fastening holes which accomodates the threaded screws. These two holes are fabricated in the longest section of the L-shaped bracket while the third hole is fabricated in the short section of the L-shaped bracket, and is used for mounting the transformer to a machine frame or supporting surface. In one embodiment of the present invention the mounting screws 62, 64, 66 and 68 are used for interconnecting the mounting brackets to the transformer.

Of course, it is within the skill of the art to use alternative methods and means for mounting the transformer without departing from the scope of the invention.

Regulating Characteristics and Electrical Characteristics of the Transformer

As was previously discussed and is shown in FIGS. 1 and 3 shunt core 16 has coil 44 and 46 seated thereon. The coils are interconnected by electrical leads 78, 80, 82 and 84 respectively. Leads 78 and 82 are in turn connected to terminal A and B respectively. Control circuit means 86, detail of which is shown in FIGS. 6 and 8 and is discussed hereinafter, generate the control signal which varies the reluctance of the shunt core to regulate the output voltage which is taken across terminal 88 and 90 respectively. It is worthwhile noting at this point, that the controlled current which flows in winding 44 and 46 respectively, is a DC current which is generated by control circuit means 86. For optimum control of the output voltage which is taken across terminal 88 and 90 it is necessary that the DC flux and the ultimately generated emf which is generated by coil 44 and 46 respectively, does not flow in the main core. Likewise, the AC flux from main core must not be permitted to change the DC voltage of the control circuit. It is also necessary that an equal magnetomotive force be presented on both legs of the shunt. These desirable qualities are achieved by winding coil 44 and 46 in opposite directions. For example, if coil 44 is wound in a right-handed manner then coil 46 is wound in a left-handed manner and vice versa. Although a split winding, that is one having a center tap 92 is shown across output terminal 88 and 90 it is within the skill of the art to eliminate the center tap without departing from the scope of this invention. Also a plurality of secondary coils can be seated on the main core.

Referring now to FIG. 8 a schematic demonstrating the flux control transformer and its interconnection with external regulated circuitry is shown. The transformer includes primary coil 10 which has a predetermined number of turns $N_p$. The primary coil 10 is interconnected to an input AC voltage which may be line voltage via terminals 94 and 96 respectively. Positioned on the core with the primary coil is secondary coil 98. The secondary coil includes a predetermined number of turns $N_s$ and is connected to output rectifier and filter means 100. Any voltage which is generated in the secondary coil is rectified and converted from AC to DC via the output rectifier and filter circuit means 100 to a DC signal. The DC signal is then supplied at output terminals 126 and 128, respectively.

Shunt coils 44 and 46 respectively, each having a predetermined number of turns are seated on the shunt core. The shunt coils are then interconnected to control circuit means 86. A feedback loop 102 interconnects the output of the transformer to the control circuit means 86. By sensing the output voltage the control circuit means adjusts the reluctance of the shunt core so that the output voltage is kept within a predetermined range. In order to supply power to the control circuit means 86, a second secondary coil 104 is seated on the main coil. Secondary coil 104 is connected to bias winding and filter means 106. The bias winding and filter means convert the AC voltage generated into the secondary coil into DC supply voltage. Of course, an external DC power supply may be used for generating supply voltage for the control circuit means.

Still referring to FIG. 8, control circuit means 86 includes a regulator chip which has a plurality of input and output terminals. The regulator chip 723 is a conventional operational amplifier which may be purchased as an off-the-shelf item. The operational amplifier has an internal reference voltage $V_{ref}$ which is generated when terminals 108, 110 and 112 are tied to a predetermined bias circuit 114. With this configuration whenever a voltage, for example, the output voltage generated at terminal 126 is applied to terminal 116 a pulse is outputted on terminal 118 when the input voltage is out of specification relative to the referenced voltage. This pulse forces transistor $Q_1$ to conduct and as a result regulate the amount of current flow through the shunt coils. In order to shunt current away from the transistor a diode $D_1$ is connected across the shunt coils.

The diode is so positioned that its anode is connected to the collector of the transistor.

FIGS. 6 and 7 are helpful in understanding the transistor and diode combination which controls the flow of current in the shunt coils. FIG. 6 shows the diode $D_1$ which is across coils 44 and 46 with its anode connected to the collector of transistor $Q_1$ and the output of the regulator chip connected to the base of transistor $Q_1$. The representative curves of current and voltage waveform are shown in FIG. 7. In operation the regulator chip senses the output voltage which appears at terminal 126 and compares it with its internal referenced voltage. As the ripple of the output voltage $V_o$ traverses below the reference voltage, the regulated chip turns on transistor $Q_1$ allowing current $I_{ce}$ to flow through the control windings. As the ripple exceeds the reference voltage the sense amplifier turns off $Q_1$. With $Q_1$ off, diode $D_1$ begins to conduct and provides a conduction path for the decaying or induced current of the control windings until the cycle repeats itself. As is evident from FIG. 7, the voltage waveform $V_{ce}$, across transistor $Q_1$, is on for a relatively short period of the total cycle. Alternately, transistor $Q_1$ is therefore on for a relatively short period of the total cycle. Since transistor $Q_1$ only conducts for a relatively short period of the total cycle heat generation is kept within acceptable limits. The shunt current ($I_{sh}$) which flows in the shunt core and/or coils is shown in FIG. 7.

The advantage of this regulating scheme is that transistor $Q_1$ has the effect of tickling the start of the flow of control current while it is in saturation. The remainder of the control current is then controlled by diode $D_1$ which also has a low conducting voltage. The net result is that typically less than 1% of the total output power is dissipated across the solid state devices and as previously stated limit the quantity of generated heat.

Figure 5:
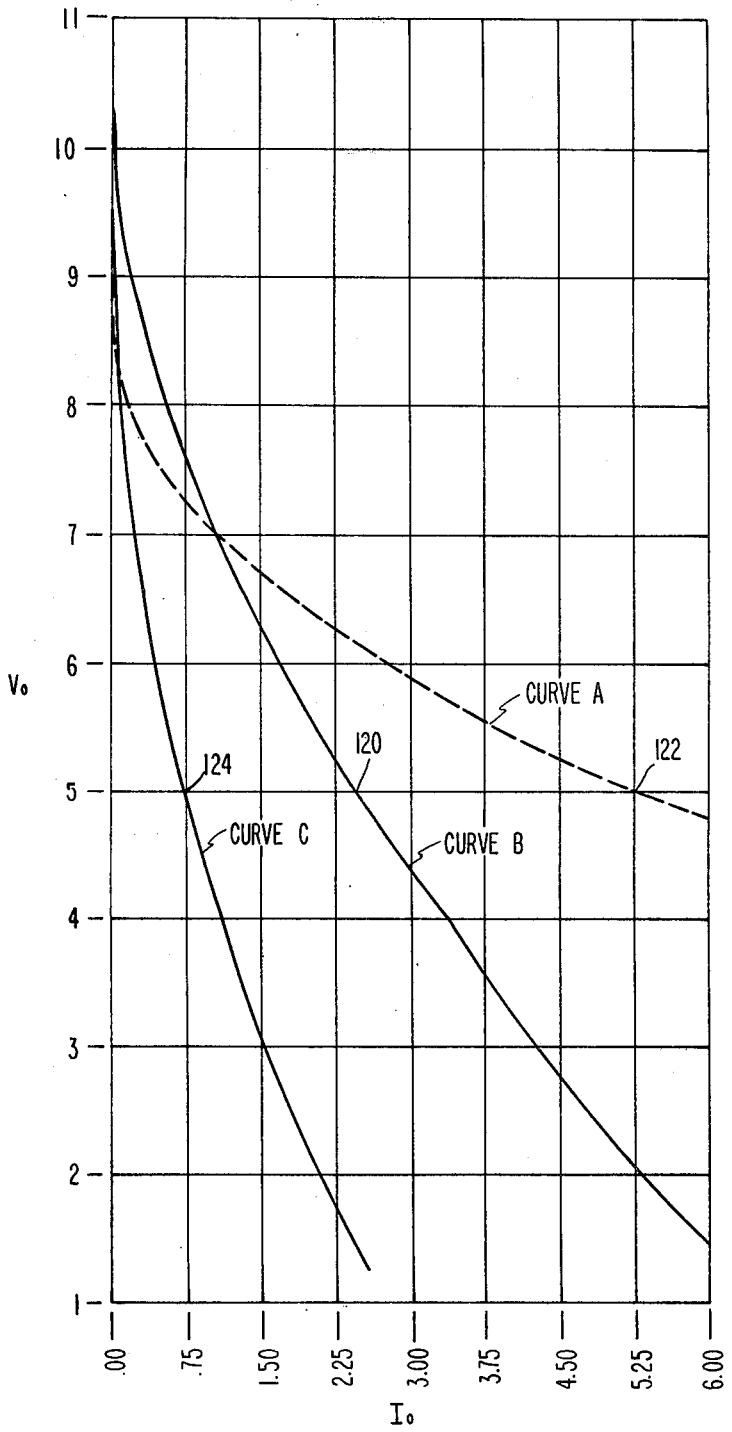
FIG. 5 is a plot showing the relationship between the transformer output voltage ($V_o$), control current ($I_{sh}$), and transformer output current ($I_o$). This plot is helpful in understanding the improvement in voltage regulation.

Turning now to FIG. 5 for a moment a plot of the output characteristics curve of the flux controlled transformer is shown. This plot is helpful in understanding the range over which the output voltage of the transformer which is fabricated according to the teaching of the present invention is regulated. In this plot the vertical axis represents DC output voltage ($V_o$); while the horizontal axis respresents DC output current ($I_o$). Curve A, curve B, and curve C represent plots of output DC voltage with the shunt core in various stages of saturation, and with various values of input AC voltage. The saturation of the shunt core is controlled by the current ($I_{sh}$) which flows in the shunt coil. For example, the plot of curve A is obtained when the input or line voltage is 181 volts and 1.5 amps of current is applied to the shunt coil which forces it into saturation. It is worthwhile noting that in this application curve A sets the maximum limit for regulation. Curve B occurs when the input for line voltage is 224 volts and the shunt current ($I_{sh}$) is 0 amps. Curve B sets the minimum limits for regulation. As is evident from FIG. 5, for a given output voltage say 5 volts, the range of regulation is between Point 120 (Curve B) and Point 122 (Curve A), respectively. One of the important characteristics of the present invention is that the range of regulation is relatively wide. This means that for a fixed or given output voltage, for example 5 volts DC, a plurality of output current ranges ($I_o$) is possible.

As was stated previously the material which is used to fabricate the bottleneck plays an important role on the range of control. This point is reinforced by the curves of FIG. 5. Curve A and Curve B are achieved using laminations to build the bottleneck. In contrast, Curve C is achieved using ferrite bars as the bottleneck. The input voltage and the shunt current which is used to generate curve C is substantially identical to that used to generate curve B. As is evident from FIG. 5 when the bottleneck material is ferrite the range of control increases. The range of control using ferrite bars is substantially between Point 122 and Point 124.

Operation

As was stated previously the device of the present invention is a flux regulating transformer which accepts an AC input voltage and outputs a regulated DC voltage. In operation, the AC input voltage is supplied to the transformer at terminals 94 and 96 FIG. 8. A secondary voltage is induced in secondary coil 98. The induced AC voltage is then rectified by output rectifying means 100 and a regulated DC voltage is outputted at terminals 126 and 128.

The output voltage at terminals 126 and 128 is sensed and is fed back into regulated means. The sense voltage is compared with a referenced voltage to see if it is within a predetermined range. If the feedback voltage is not substantially equivalent to the referenced voltage the regulator chip outputs a control pulse which turns on transistor $Q_1$ and forces current flow in the shunt coils. By inducing current flow in the shunt coils the reluctance of the shunt core changes which in turn regulates the flow of flux from the main core. This process continues until the output voltage at terminals 126 and 128 is within the predetermined specification.

Power for the regulated chip and its associated circuit is supplied by a winding and a bias winding and filter. Instead of using the bias winding a DC voltage supply $V_{cc}$ can be used to supply the necessary DC power. This completes the description of the preferred embodiment of the invention.

The invention has been shown and described with reference to a detailed embodiment and several variations. However, it should be understood that other changes can be carried out by those skilled in the art without departing from the spirit and scope of the invention.

What is claimed is:

1. A regulating transformer comprising in combination:

a main "O" shaped core for supporting primary and secondary coils:

a shunt "O" shaped core for supporting at least one control coil; said shunt core being positioned in spaced juxtaposed alignment with the main core;

separate flux interconnecting means placed such that the magnetic flux from the main core travels at right angles to said flux interconnecting means for interconnecting the main core and the shunt core; said flux interconnecting means including a plurality of stacked I-shaped laminations placed such that the magnetic flux from the main core travels at right angles to the plurality of laminations and also being operable to mechanically couple the main and shunt cores;

fastening means, interconnecting the cores and flux interconnecting means, operable to give structural strength to said transformer; and mounting means operable for mounting said transformer.

2. The transformer as claimed in claim 1 further including circuit control means connected to said shunt core coil; said circuit control means being operable to limit magnetic flux flow in the shunt core.

3. The device as claimed in claim 1 wherein the flux interconnecting means includes ferrite bars.

4. Structure for a shunt controlled voltage regulating transformer comprising in combination;

a rectangular shaped main core having primary and secondary coil thereon;

said main core having the central portion being removed;

first electrical conductors being operably connected to said primary coil;

second electrical conductors being operably connected to the secondary coil;

connecting core means with a surface area less than the surface area of the main core and being connected to the main core for leaking magnetic flux away from the main core, said connecting core means including a plurality of stacked I-shaped laminations placed such that the magnetic flux from the main core travels at right angles to the plurality of laminations;

a shunt core having a geometry substantially equivalent to the geometry of the main core;

said shunt core being connected to the connecting core means and controlling the flow of magnetic flux in the main core;

control coil being seated on said shunt core; and electrical conductors being connected to said control coil.

5. Magnetic structure for a transformer comprising in combination:

a main squared O-shaped core for supporting primary and secondary coils;

a shunt squared "O" shaped core being positioned in spaced juxtaposed alignment with said main core for supporting at least one control coil;

bottleneck means being operable to interconnect the main core and shunt core such that the magnetic flux from the main core travels at right angles to said bottleneck means and including a plurality of stacked I-shaped laminations placed such that the magnetic flux from the main core travels at right angles to the plurality of laminations;

said bottleneck means being operable for controlling magnetic flux and for structurally supporting said transformer.

6. The device as claimed in claim 5 where the cores and bottleneck means are fabricated from material having high magnetic permeance.

7. Tne device as claimed in claim 5 where the bottleneck means is fabricated from ferrite material.

8. The device as claimed in claim 5 where the bottleneck means is fabricated from a magnetic material with high resistivity.

* * * * *